US010490018B2

(12) United States Patent
Ghaly

(10) Patent No.: US 10,490,018 B2
(45) Date of Patent: Nov. 26, 2019

(54) GAMING DEVICE AND METHOD FEATURING A SECONDARY PAY LINE

(76) Inventor: Nabil N. Ghaly, Huntington Station, NY (US)

( * ) Notice: Subject to any disclaimer, the term of this patent is extended or adjusted under 35 U.S.C. 154(b) by 1708 days.

(21) Appl. No.: 11/698,515

(22) Filed: Jan. 26, 2007

(65) Prior Publication Data

US 2007/0178964 A1 Aug. 2, 2007

Related U.S. Application Data

(60) Provisional application No. 60/762,822, filed on Jan. 30, 2006.

(51) Int. Cl.
*A63F 9/24* (2006.01)
*G07F 17/32* (2006.01)

(52) U.S. Cl.
CPC ..... *G07F 17/32* (2013.01)

(58) Field of Classification Search
CPC .. G07F 17/3267; G07F 17/34; G07F 17/3213; G07F 17/326; G07F 17/32
USPC ..... 463/16–20
See application file for complete search history.

(56) References Cited

U.S. PATENT DOCUMENTS

| | | | | |
|---|---|---|---|---|
| 5,997,401 | A * | 12/1999 | Crawford | 463/20 |
| 6,168,520 | B1 * | 1/2001 | Baerlocher et al. | 463/16 |
| 6,270,412 | B1 * | 8/2001 | Crawford et al. | 463/20 |
| 6,935,947 | B1 * | 8/2005 | Singer et al. | 463/16 |
| 2004/0053673 | A1 * | 3/2004 | Mishra | 463/20 |
| 2004/0087359 | A1 * | 5/2004 | Cuddy et al. | 463/20 |
| 2004/0140618 | A1 * | 7/2004 | Fox | 273/292 |
| 2006/0025192 | A1 * | 2/2006 | Walker et al. | 463/13 |
| 2006/0068893 | A1 * | 3/2006 | Jaffe et al. | 463/20 |

* cited by examiner

*Primary Examiner* — Steve Rowland

(57) ABSTRACT

A gaming device method and apparatus are disclosed, and are accomplished by a slot machine that includes one, or a plurality of primary pay lines, as well as one or a plurality of secondary pay lines, wherein symbols occurring at the primary pay lines during a plurality of independent spins are mapped into the secondary pay lines.

18 Claims, 9 Drawing Sheets

GAMING DEVICE AND METHOD FEATURING A SECONDARY PAY LINE

This utility application benefits from provisional application of U.S. Ser. No. 60/762,822 filed on Jan. 30, 2006.

BACKGROUND OF THE INVENTION

This invention relates generally to slot machines, also known as coin operated gaming machines, and in particular a mechanical reel, or a video slot machine, wherein a plurality of winning lines, also known as pay lines, are formed during a plurality of spins.

Slot machines are well known, and have been around for many years. Examples of traditional slot machines include gaming devices wherein a plurality of symbols is provided on the periphery of a plurality of rotating reels. The reels are randomly stopped and a win decision is made based on the combination of symbols stopping at a single winning line, or a plurality of winning lines. Video slot machines are also known wherein a micro-processor is used to control the functions performed by the machine and a CRT, or an LCD screen is provided to depict the action of the rotating reels.

The prior art of slot machines has a common characteristic of determining if a win has occurred during a single spin of the reels that corresponds to a wager by the player. Also, certain prior art slot machines allow one or more reels to move by one position after the reels come to a complete stop, prior to the determination of a win. Further, other prior art slot machines are designed to re-spin one or more reels, and repeat the outcome, upon the occurrence of a predesignated symbol as part of bonus play. However, to the inventor's knowledge, none of the slot machines known in the art employs symbols occurring at a pay line during a plurality of independent spins to populate new pay lines. The gaming device described in this invention incorporates such new concept, which offers the player a plurality of independent spins for the occurrence of a winning combination of symbols at one, or a plurality of winning lines. This new concept could be implemented as a primary gaming device, or as a bonus game, which provides a player a plurality of free spins during which the player can form winning combinations at one, or a plurality of pay lines.

OBJECT OF THE INVENTION

Because it is desirable to offer players a new variety of slot machines that employ new features, it is an object of this invention to provide a coin operated gaming device that uses symbols occurring at one, or a plurality of winning lines, also known as pay lines, during a plurality of independent spins, to populate one or a plurality of new winning lines.

It is also an object of this invention to afford the player an opportunity to first define or select one, or a plurality of winning combination of symbols, and then afford the player a plurality of spins for the occurrence of said winning combination of symbols.

It is still an object of this invention to provide an interactive gaming device, wherein a player can bet on the occurrence of a winning combination of symbols, during a plurality of spins, in a specific order, or as a "boxed" set of symbols where the order of the symbols in the set is not required for the winning combination.

It is another object of this invention to provide an interactive gaming device that affords a player an opportunity to define, or select, a winning line at which a selected winning combination of symbols would occur.

It is a further object of this invention to provide a slot machine with a bonus game, which affords the player a plurality of spins during which a selected winning combination of symbols would occur at a selected winning line.

It is also an object of this invention to provide a slot machine with an interactive feature that enables a player to hold one or more symbols at a selected winning line during a plurality of spins to help the occurrence of a selected winning combination.

It is still an object of the present invention to provide a gaming device that includes at least one new winning line populated by symbols from a plurality of consecutive spins.

It is further an object of this invention to provide a gaming device that includes at least one new winning line that employs symbols from a plurality of spins that are not consecutive.

It is another object of this invention to provide a gaming device that employs symbols occurring at predefined positions of a winning line, during a plurality of spins, to populate at least one new winning line.

It is also an object of this invention to provide a gaming device that includes at least one new winning line, wherein symbols occurring at a winning line during a plurality of spins are randomly mapped into said new winning line.

It is further an object of this invention to provide a gaming device, wherein symbols occurring at a plurality of winning lines, during a plurality of spins, are mapped into a plurality of new winning lines.

It is another object of this invention to provide an interactive gaming device, which incorporates a variety of visual and audible indications to heighten the enjoyment of play.

SUMMARY OF THE INVENTION

The foregoing and other objects of the invention are accomplished by a slot machine that includes one, or a plurality of primary winning lines, also known as pay lines, as well as one or a plurality of secondary (new) winning lines, wherein symbols occurring at the primary winning lines during a plurality of independent spins are mapped into the secondary winning lines. This invention could be implemented using a mechanical reel machine, or a video slot machine. In its simplest form this new concept could be realized using a three reel gaming device with one primary winning line, and at least one secondary winning line. A secondary winning line is populated with symbols during a minimum of two independent spins. In a more complicated embodiment, symbols occurring at a single primary winning line during three consecutive spins are used to populate eighteen (18) secondary winning lines.

Also, this concept could be implemented with a plurality of primary winning lines. For example, in a video slot machine that employs three rows, and five simulated reels (total of 15 symbols), and has five (5) primary wining lines, this concept could be implemented to populate twenty five secondary winning lines located on five auxiliary screens during two independent spins. During the first spin, the symbols occurring at each reel are copied to the corresponding reel position on the auxiliary screens. Then, during the second spin the remaining playing positions (corresponding to 4 reels) at the secondary winning lines are populated using symbols occurring at the primary winning lines. As a variation of this embodiment, the mapping of symbols from two independent spins into the secondary winning lines is such that symbols from two (2) reels during the first spin, and three reels during the second spin are used. In general, and as would be appreciated by a person skilled in the art, if symbols from N reels are used during the first spin, then the remaining playing positions are populated by symbols from the remaining 5-N reels during the second spin.

It should be noted that the number of primary pay lines and secondary pay lines are design choices. The new concept described in this invention could be implemented using any number of primary and secondary pay lines. Further, this concept could be implemented in slot machines that do not employ pay lines. For example, the 5 reel slot machine described above could be implemented without pay lines. A winning combination of symbols at the primary reels would be based on the repeated occurrence of symbols at adjacent reels, including the first reel. Similarly, a winning combination of symbols at the secondary reels (located at the five auxiliary screens) would be based on the repeated occurrence of symbols at adjacent reels, including the first reel.

It should also be noted that the independent spins do not have to be consecutive, or predefined. An embodiment that implements this new concept could incorporate a random algorithm that selects symbols at random from a plurality of spins to populate the secondary winning line or lines. Such an implementation would provide an incentive to players to continue playing until all secondary winning lines are populated.

Further, a different gaming device could incorporate a plurality of switches to enable a player to interact with the machine during a bonus game. The player can define or select a winning combination of symbols for the bonus game, as well as a specific winning line. The player employs said plurality of switches to hold one or more symbols, at the selected winning line, to help the occurrence of the selected winning combination during the free spins of the bonus game. As a variation of this application, in a bonus game, the player is afforded a plurality of free spins during which he or she must help achieve at least two occurrences of a selected winning combination of symbols. This new interactive bonus game could be implemented on a conventional three, four, or five rotating reel machine, as well as on a video slot machine.

In accordance with a preferred embodiment of the invention, the above described concept is implemented using a three reel mechanical machine that employs one primary winning line, and three secondary winning lines. The secondary winning lines are populated during two consecutive independent spins. During the first spin, the primary winning line is fully populated. However, each of the secondary winning lines is assigned one of the three symbols occurring at the primary line. More specifically, the right symbol is assigned to the right position of the first secondary line, the center symbol is assigned to the center position of the second secondary line, and the right symbol is assigned to the right position of the third secondary line. During the second spin, the symbols occurring at the primary winning line are assigned to the blank positions at the three secondary lines, such that the left and center symbols are assigned to the left and center positions at the first secondary line, the left and right symbols are assigned to the left and right positions at the second winning line, and the center and right symbols are assigned to the center and right positions at the third secondary line. For a play cycle of two spins, and if the player wishes to activate all available winning lines, he or she must deposit five wagers, two for the primary line for the first and second spins, and three for the secondary lines for the second spin.

BRIEF DESCRIPTION OF THE DRAWINGS

These and other more detailed and specific objectives will be disclosed in the course of the following description taken in conjunction with the accompanying drawings wherein.

DESCRIPTION OF THE PREFERRED EMBODIMENT

Figure 1:
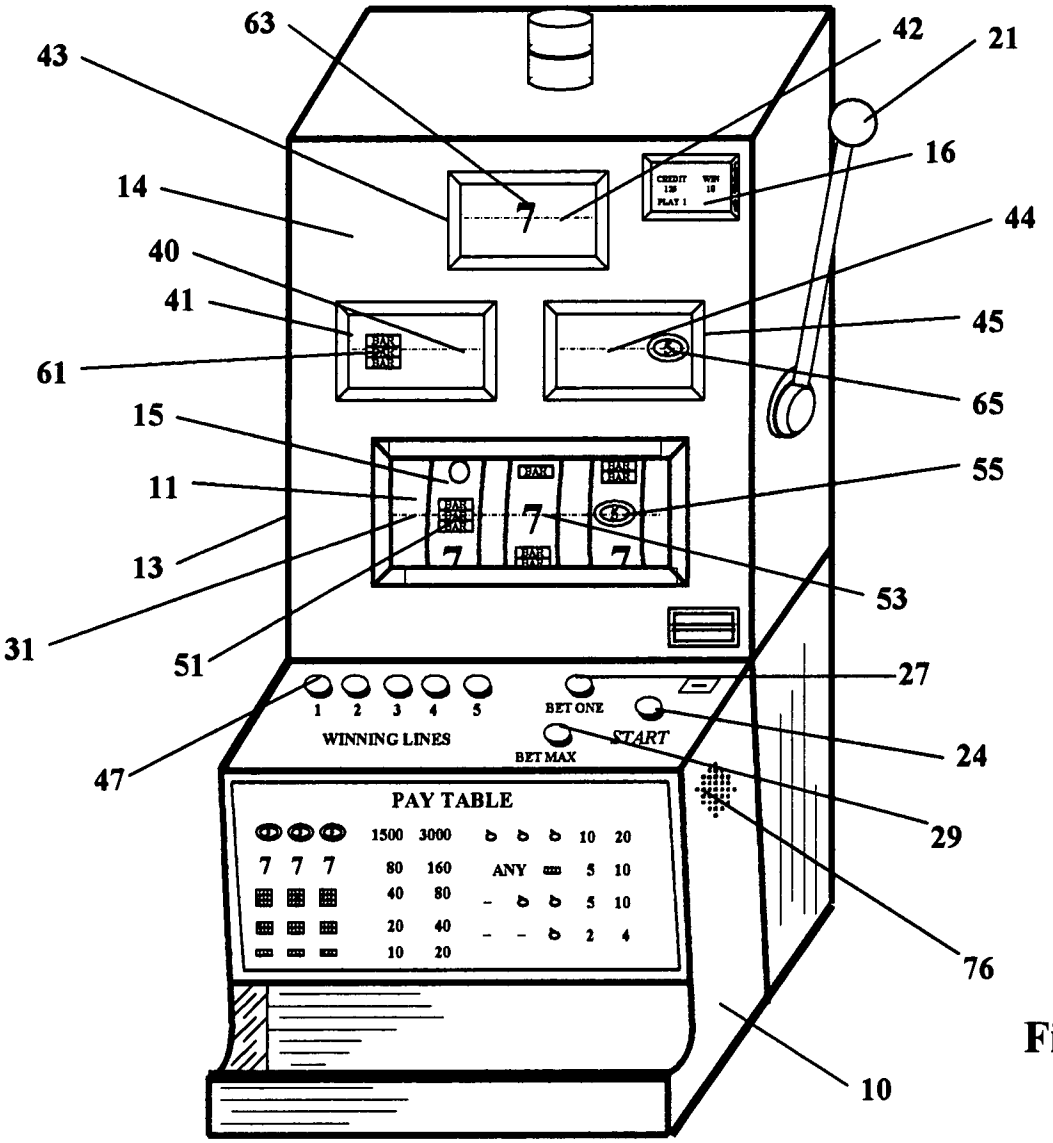
FIG. 1 is a perspective view of the preferred embodiment of a gaming device according to the invention, showing one primary winning line, and three secondary winning lines. This view also indicates the mapping of the symbols from the primary winning line to the three (3) secondary winning lines during the first spin.

Referring now to the drawings where the illustrations are for the purpose of describing the preferred embodiment of the invention, and are not intended to limit the invention hereto, FIG. 1 is a front plan view of a gaming device 10 is comprised of a housing 13 having a face 14 and a transparent glass window 11 revealing three rotating reels 15. The preferred embodiment provides one primary winning line 31, which is indicated on the surface of the window 11. The primary winning line is configured as a horizontal line 31 that maps the three playing positions provided by the three reels 15. The gaming device 10, also, has conventional controls including an activation lever 21, an activation "START" button 24, "BET ONE" 27, and "BET MAX" 29 buttons. Further, the preferred embodiment includes three LCD screens 41, 43 & 45, each of which provides a secondary winning line 40, 42 & 44. The preferred embodiment, also, includes five switches 47 to enable a player to select up to five winning lines for a play cycle (two independent spins). The five winning lines are configured such that lines 1 & 2 represent the primary winning line 31 for the first and second spin, and lines 3, 4 & 5 represent the three secondary winning lines 40, 42 & 44 that are partially populated during the first spin, and fully populated during the second spin. As would be appreciated by a person skilled in the art, any other type screen, or indicator, could be used to provide the secondary winning lines. Examples of screen types known in the art include cathode ray tube (CRT), digital light processor (DLP), and plasma screens.

It should be noted that the concept described herein could be used with any set of slot machine symbols. For the purpose of describing the preferred embodiment, the traditional symbols of cherry, single bar, double bar, triple bar, lucky seven, and the five multipliers are used.

If a player elects to operate this gaming device as a conventional slot machine, then he or she need to activate only one line (the first line), and in such a case the play cycle is automatically adjusted to one spin, and only the primary winning line 31 is in effect. Alternatively, if the player selects two or more winning lines (player must deposit two or more wagers), the play cycle is automatically adjusted to two spins, the secondary winning lines are activated, and populated during said two cycles.

Figure 6:
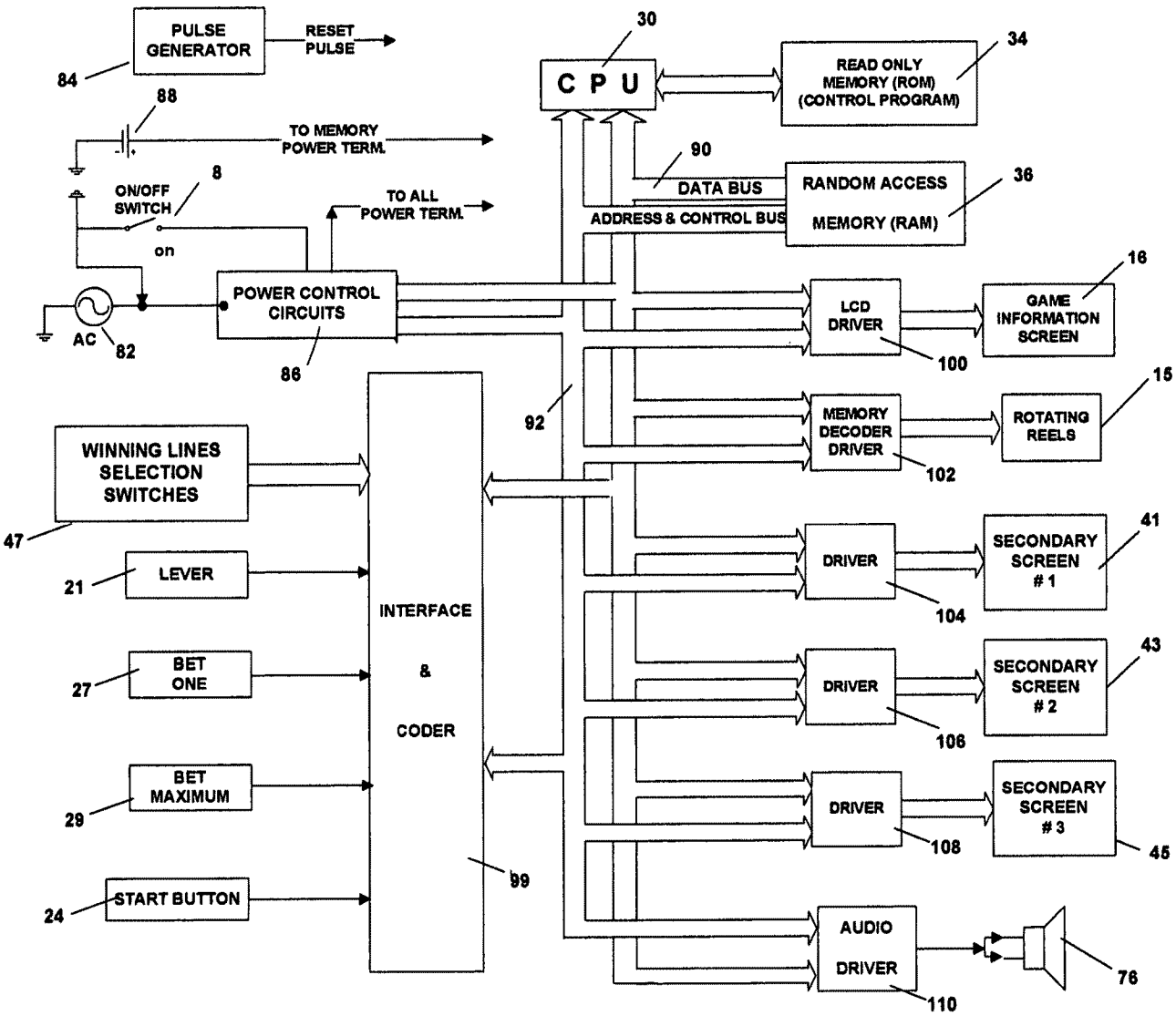
FIG. 6 indicates a block diagram of the microprocessor circuitry used to control the gaming device according to the invention.

A block diagram of the control circuitry to operate this gaming device 10 is illustrated in FIG. 6. This block diagram includes a micro-controller with a central processing unit (CPU) 30 and system memory. The system memory preferably comprises a separate read-only memory (ROM) 34, and battery-backed random-access memory (RAM) 36. It will be appreciated, however, that the system memory may be implemented on any of several alternative types of memory structures or may be implemented on a single memory structure. For example, the read-only memory 34 may be replaced or supplemented with a mass storage unit such as a removable flash memory or a hard drive. The system memory is used to store game-related data associated with the chance games played on the slot machine. The game-related data may, for example, include game code, math tables, a random number generator, and audio resources.

Referring again to FIG. 6, in order to operate the slot machine, the ON-OFF switch 8 should be activated from the "off" position to the "on" position, which causes power to be supplied from the main external power supply 82 to the power control circuits 86, which in turn energizes all terminals of the gaming device 10. The slot machine also includes a rechargeable battery 88, which feeds the memory power terminals in order to ensure that critical data is not lost in the event of a loss of the external electrical supply 82. Upon energizing the machine, a pulse generator 84 will generate a pulse to reset various components of the slot machine. Also, an interface and coding device 99 is used as an input interface between the various control elements and the CPU 30. These control elements include the main lever switch 21, "BET ONE" switch 27, "BET MAX" switch 29, start button 24, winning line selection buttons 47, and other conventional control elements of a slot machine. Similarly a plurality of drivers is used to interface the CPU 30 with various output elements of the gaming device. These drivers include a memory decoder driver 102 to interface the CPU 30 with the rotating reels 15. A plurality of screen drivers 100, 104, 106 & 108 is used to interface the CPU 30 with the game information screen 16, and the secondary screens 41, 43 & 45 that provide the three secondary winning lines 40, 42 & 44. Further, an audio driver 110 is used to interface the CPU 30 with a speaker 76. A common address and control bus 92, and a separate common data bus 90 are used to interconnect the central processing unit 30 with the interface and coding device 99, the various drivers listed above, the read only memory (ROM) 34, and the random access memory (RAM) 36.

It should be noted that the above description of the block diagram illustrated in FIG. 6, and using interface and coding devices, and memory decoding devices, is being provided for the purpose of describing the preferred embodiment, and is not intended to limit the invention herein. As would be appreciated by a person skilled in the art, a game designer may elect to use a microprocessor, or a micro-controller that includes input and output ports to interface input switches, and output devices with the CPU, as well as built in video and audio drivers to directly interface the CPU with various screens, and with an audio circuit or speaker. Such microprocessors are well known in the art.

Prior to activating the start lever 21 or button 24, the player must select the number of winning lines desired, and deposit the corresponding wager using the select line buttons 47, BET ONE 27, and/or BET MAX 29 buttons. If the player selects a single line, then the gaming device operates as a conventional slot machine, wherein a play cycle consists of one spin. Upon the activation of the start lever 21 or button 24, and the spinning and stopping of the reels 15, a win determination is made based on the combination of symbols occurring at the primary winning line 31.

Alternatively, if the player selects two or more lines, then the play cycle is adjusted to two spins. Upon the first activation of the start lever 21 or button 24, and the spinning and stopping of the reels 15, a first win determination is made based on the combination of symbols occurring at the primary winning line 31. Also, the three symbols (including any blanks) occurring at the primary winning line are mapped into the three secondary lines, such that the left symbol 51 is mapped into the left position 61 of the first secondary line 40, the center symbol 53 is mapped into the center position 63 of the second secondary line 42, and the right symbol 55 is mapped into the right position 65 of the third secondary line 44.

Figure 2:
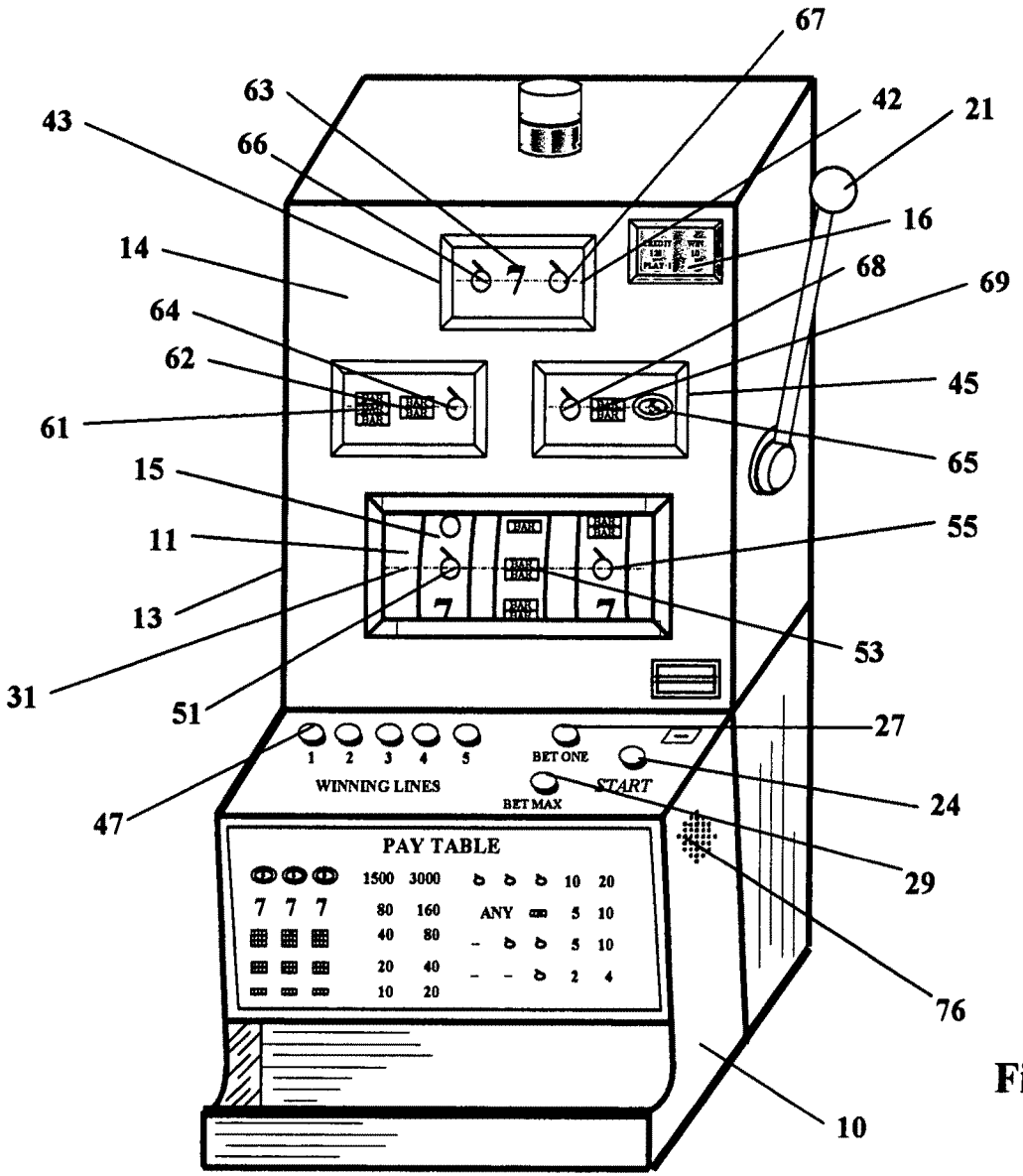
FIG. 2 indicates the mapping of the symbols from the primary winning line to the three (3) secondary winning lines during the second spin.

Upon the second activation of the start lever 21 or button 24, and the spinning and stopping of the reels 15, a second win determination is made based on the combination of symbols occurring at the primary winning line. Also, as indicated in FIG. 2, the three symbols (including any blanks) occurring at the primary winning line 31 are mapped into the remaining positions of the three secondary winning lines 40, 42 & 44, such that the center and right symbols 53 & 55 are mapped into the center and right positions 62 & 64 of the first secondary winning line 40, the left and right symbols 51 & 55 are mapped into the left and right positions 66 & 67 of the second secondary winning line 42, and the left and center symbols 51 & 53 are mapped into the left and center positions 68 & 69 of the third secondary winning line 44. A third, fourth and fifth win determinations are then made based on the combination of symbols occurring at the first 40, second 42, and third 44 secondary winning lines, provided the player has deposited the proper wager to activate these lines.

It should be noted that the above described mapping of the symbols occurring at the primary winning lines, during the first and second spins, into the secondary winning lines is being provided for the purpose of describing the preferred embodiment, and is not intended to limit the invention herein. As would be appreciated by a person skilled in the art, a different mapping configuration could be used. For example, two symbols could be mapped into each of the secondary winning lines during the first spin, and a third symbol could be mapped into each of said lines during the second spin. Also, the symbols from the first and second spins could be randomly mapped into the three secondary lines 40, 42 & 44. In addition, the three secondary lines could be provided on a single screen, rather than on three different screens as described for the preferred embodiment.

Further, the number of spins in a playing cycle is a design choice, and is not limited to the two spins illustrated for the preferred embodiment. As would be appreciated by a person skilled in the art, a designer could elect to implement this concept using a gaming device that employs three or more spins per playing cycle. For example, an alternate embodiment that employs three spins per play cycle could be implemented using one primary winning line, and eighteen

Figure 3:
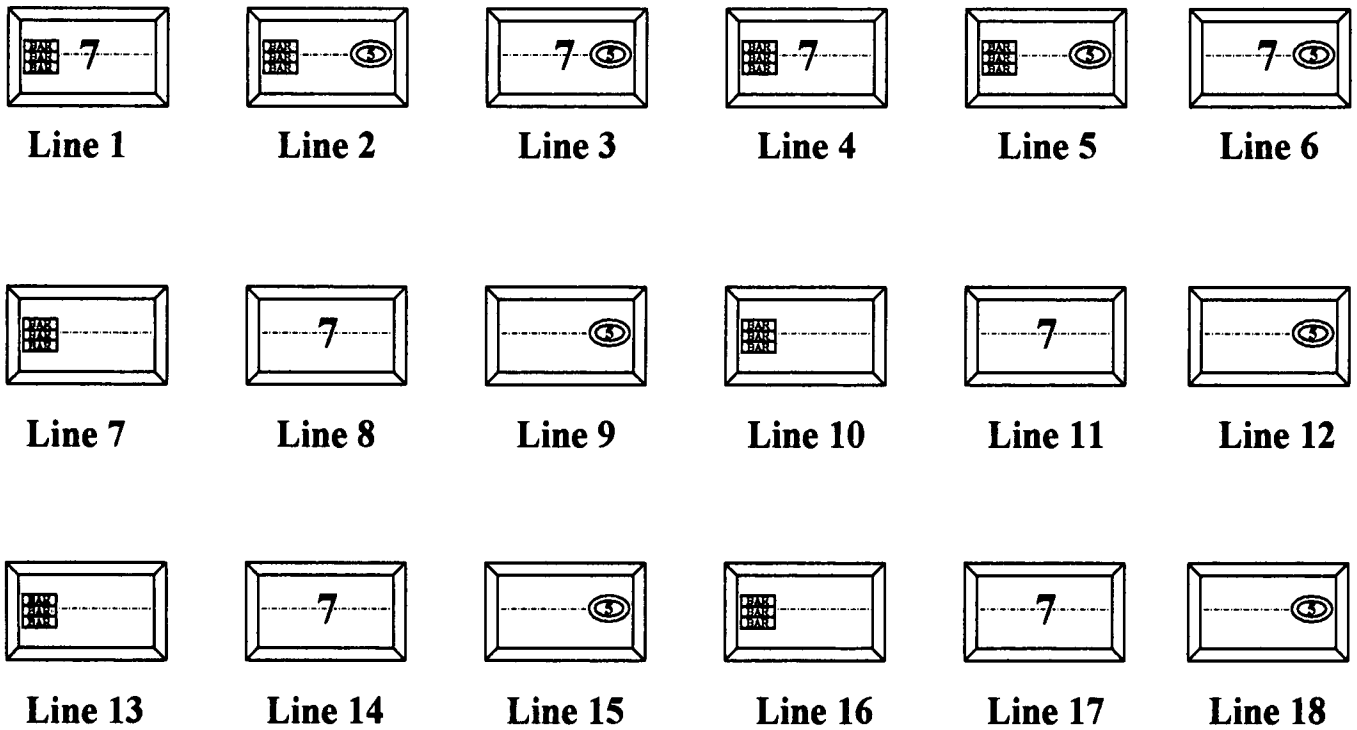
FIG. 3 shows a configuration for an alternate embodiment that employs one primary winning line, and eighteen secondary winning lines that are populated with symbols during three spins. Also, indicated is the proposed mapping of symbols from the primary winning line to the secondary winning lines, for this alternate embodiment, during the first spin.
Figure 3:
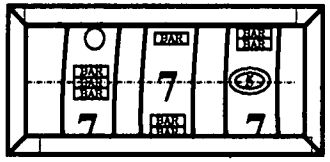
Figure 4:
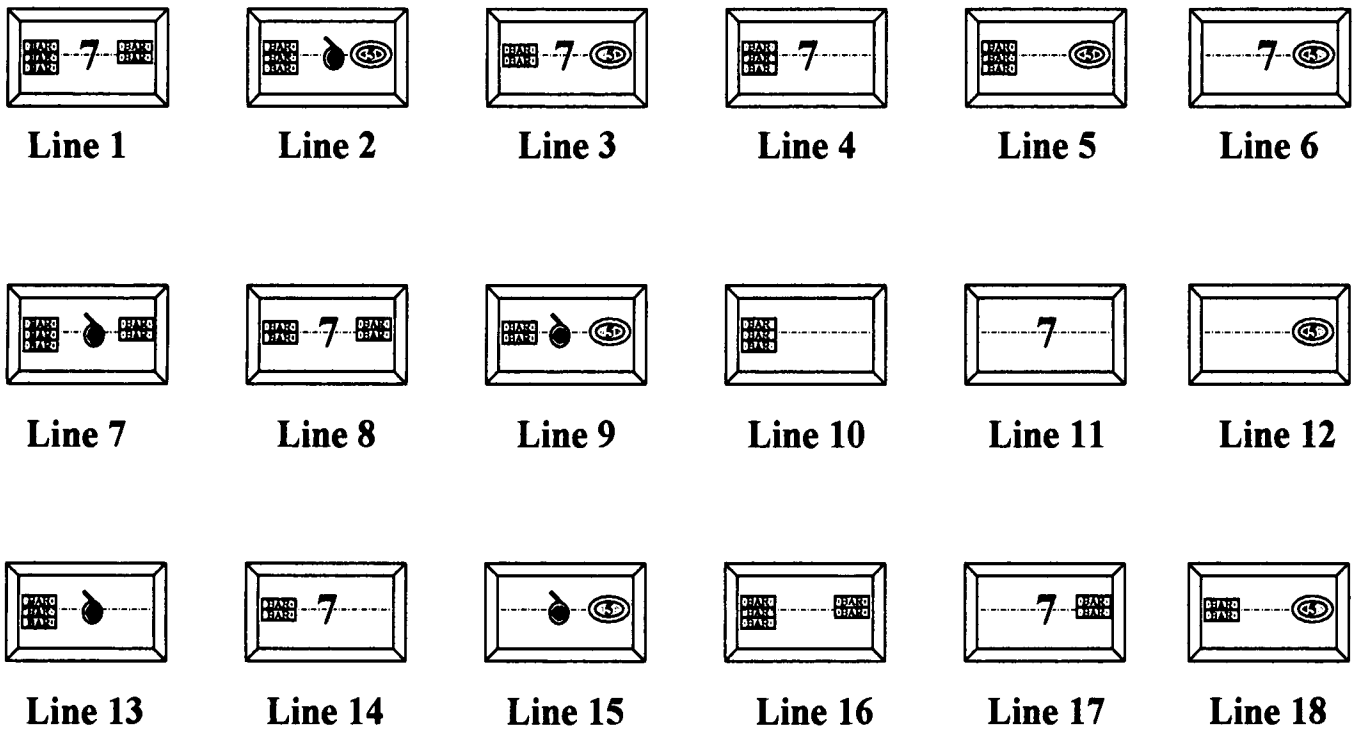
FIG. 4 shows a proposed mapping of symbols from the primary winning line to the secondary winning lines, for the alternate embodiment, during the second spin.
Figure 4:
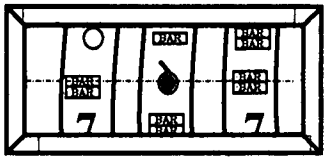
Figure 5:
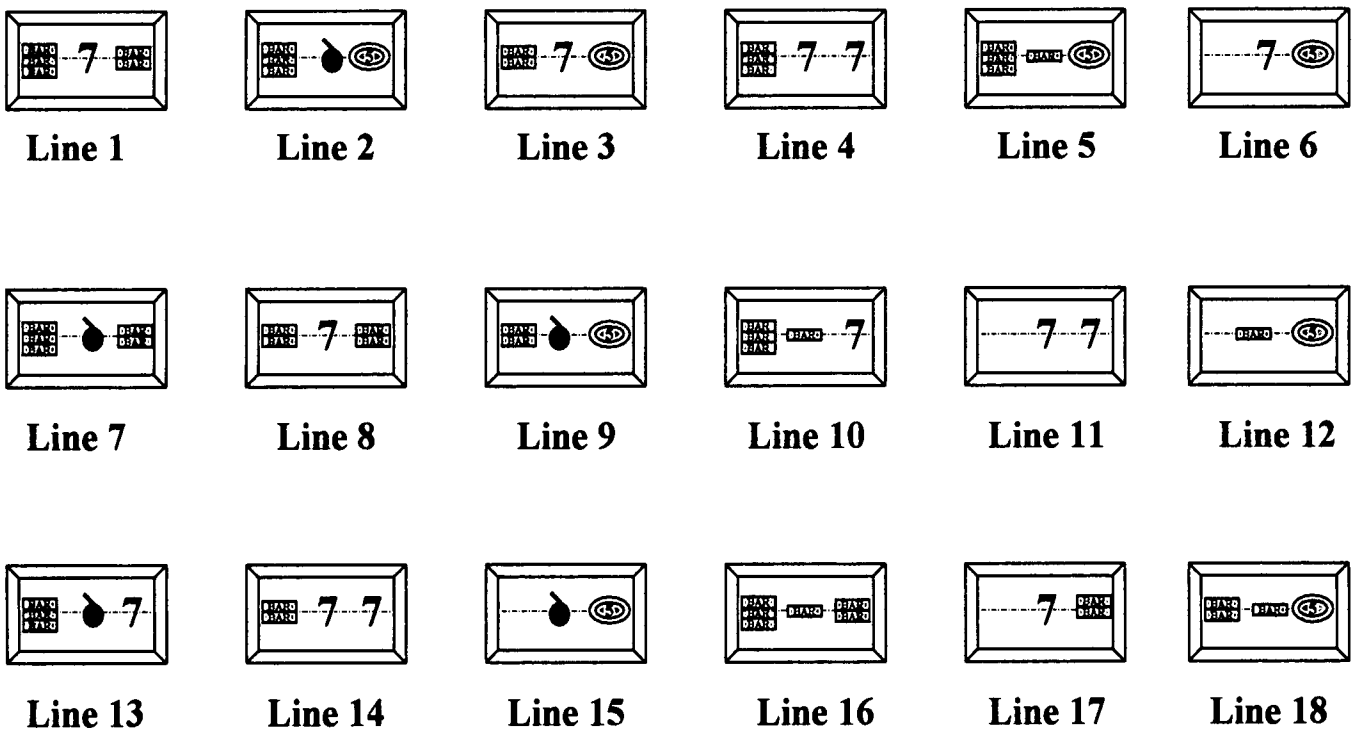
FIG. 5 shows a proposed mapping of symbols from the primary winning line to the secondary winning lines, for the alternate embodiment, during the third spin.
Figure 5:
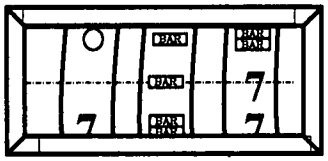

(18) secondary winning lines. In such a case the eighteen (18) secondary winning lines are populated by symbols occurring at the primary winning line during said three spins. One example of the interim steps used to populate said secondary winning lines is demonstrated in FIGS. 3-5. As in the case of the preferred embodiment, there are a high number of permutations with respect to the mapping of the symbols occurring at the primary winning lines, during the three spins, into the 18 secondary winning lines.

In addition, the concept of using a plurality of independent spins to populate one, or a plurality of secondary winning lines could be implemented as a bonus game, wherein a player is awarded a plurality of free spins to help realize a selected winning combination, or combinations of symbols. At the beginning of the bonus game, the player is requested to select a winning combination and a specific winning line (if more than one primary winning line is used) for the bonus game. The player is also provided with a plurality of control switches (one for each reel) to enable the player to hold a symbol at the selected winning line. The player is instructed to hold a symbol at the winning line if that symbol is part of the selected winning combination for the bonus game. If said selected combination occurs during the free spins, the player is awarded a bonus payout. In a variation of this bonus game, the player could be challenged to help the occurrence of as many winning combinations as possible during the plurality of free spins awarded to the player. The player is instructed to use the interactive switches to hold any symbol at the winning line. Once a symbol is held, it cannot be released until a winning combination occurs. This process continues until all free spins are exhausted. Obviously, if the player does not activate any of the interactive switches, then the normal occurrence of a winning combination could take place without help from the player.

Figure 7:
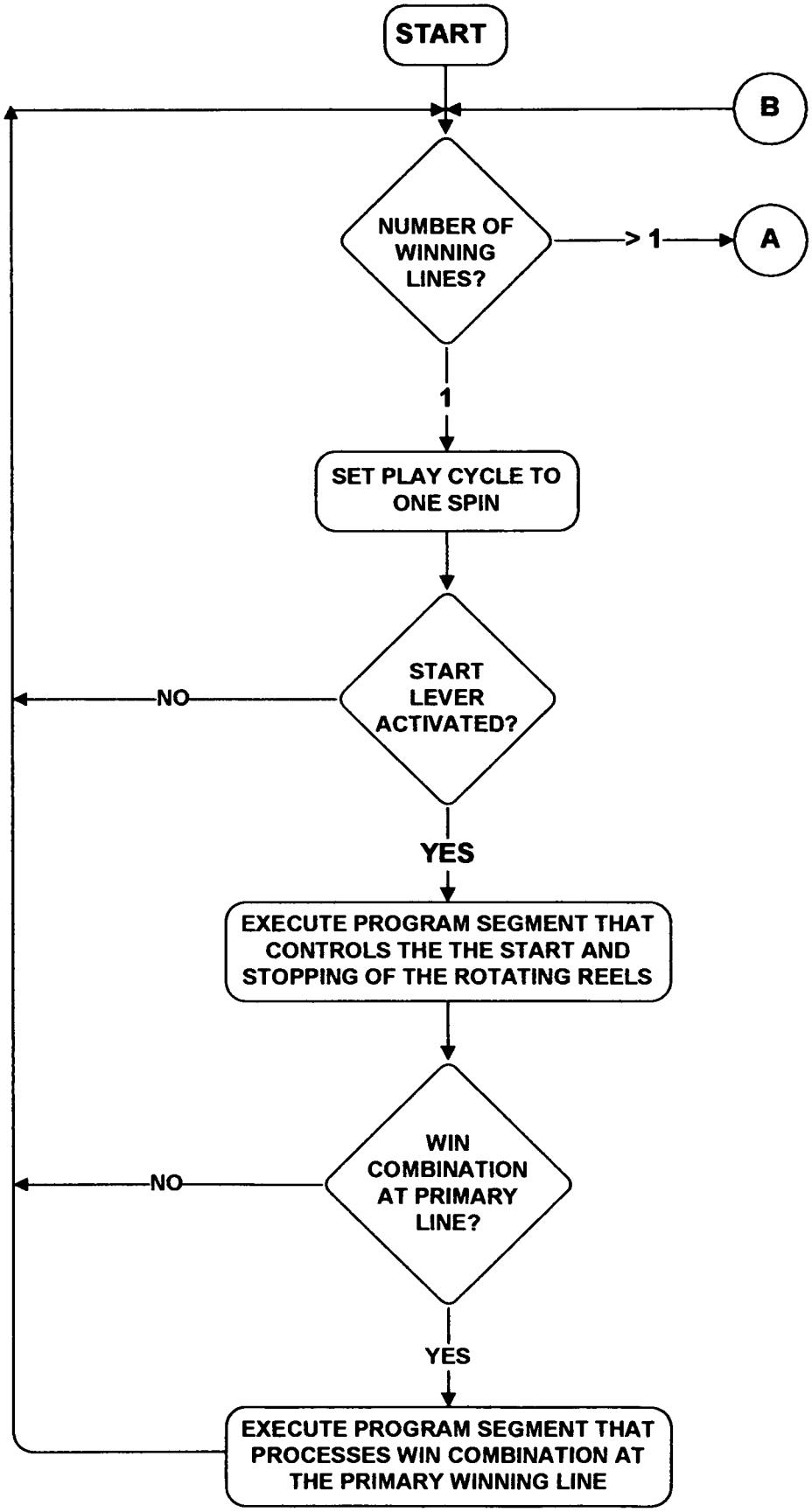
FIGS. 7-9 indicate a logical flow diagram illustrating the main program functions performed by the game code executed on the microprocessor that controls the gaming device according to the preferred embodiment of the invention.
Figure 8:
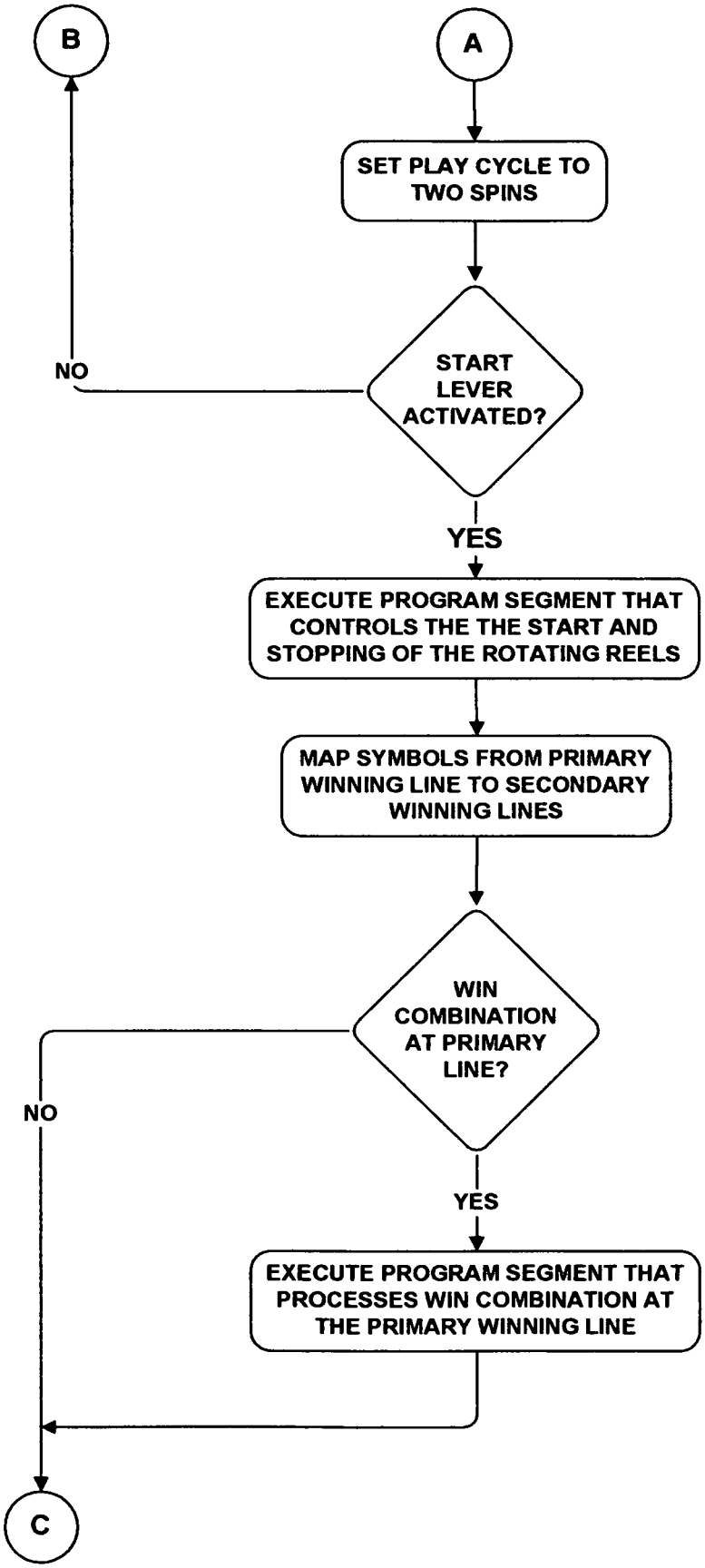
Figure 9:
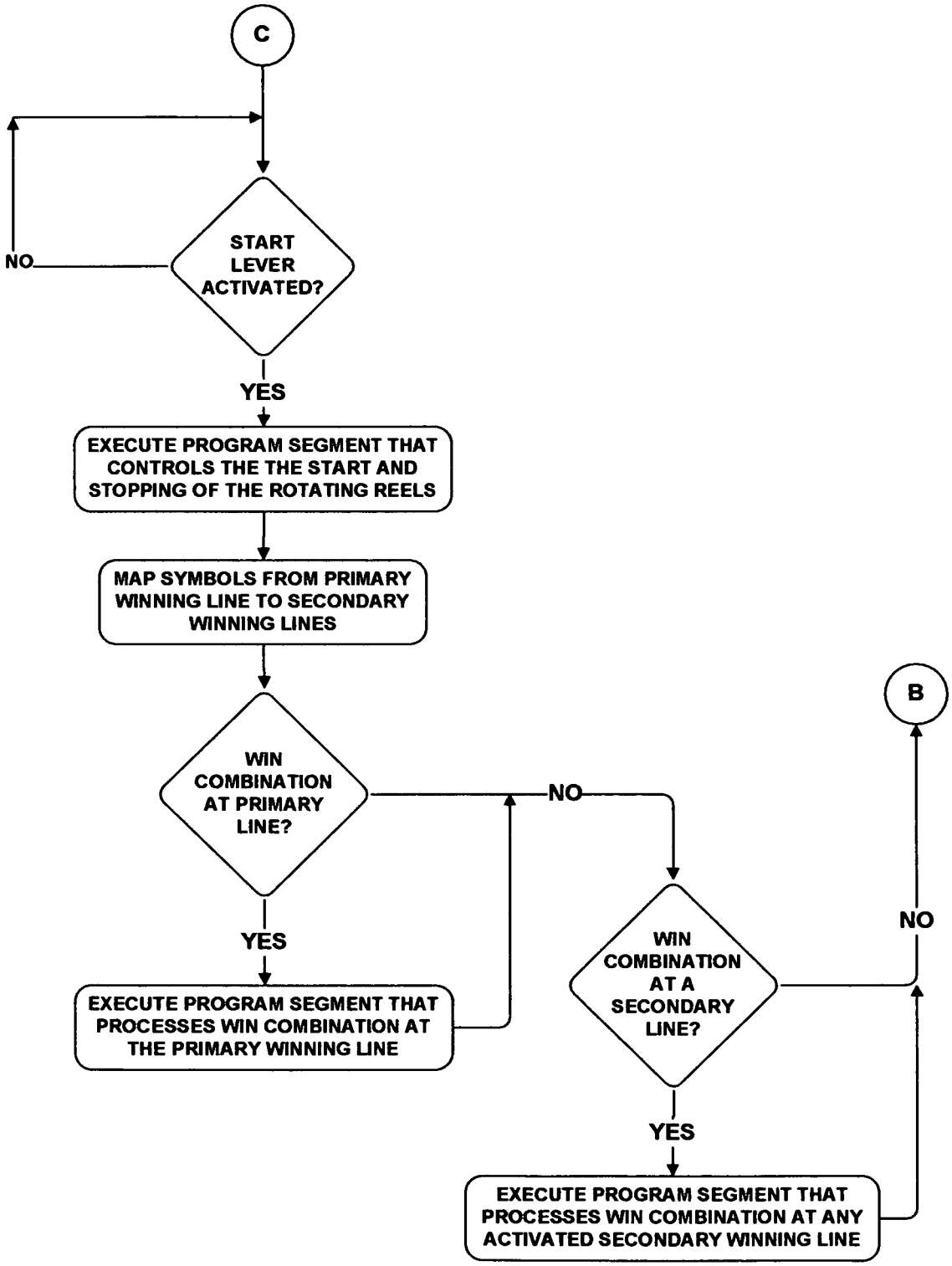

With respect to the detailed operation of the preferred embodiment, the main logic steps utilized are illustrated in flow diagram form in FIGS. 7-9, which interconnect with each other at the places shown in the various figures. Even though specific reference will not be made to this diagram in the following description of the operation of the gaming device, periodic reference to this diagram may prove to be helpful to the reader hereof.

Upon the activation of the "On-Off" switch 8, and the initialization of the program variables, the gaming device is ready to operate. The player may set forth an amount to wager using the SELECT LINE 47, "BET ONE" 27, and/or "BET MAX" 29 buttons. The wager amount is signaled to the CPU 30 by a coin/credit detector.

As the player deposits the wager for the game, the CPU 30 executes a control program segment that determines the number of lines selected and activated by the player. If the number of lines equal to "1," then the CPU selects and executes a program segment that operates this gaming device as a conventional slot machine. In such a case, and upon the activation of the start lever 21, or button 24, the CPU 30 executes a control program segment that activates the spinning, and stopping functions of the reels, and determines if a win condition has occurred at the primary winning line. In the event of a win, the player is awarded a payout that is credited to his or her credit balance.

Alternatively, if the number of winning lines selected and activated by the player is two or more, then the CPU 30 selects and executes a program segment that establishes a play cycle of two spins. Then upon the first activation of the start lever 21, or button 24, the CPU 30 executes a control program segment that controls the spinning and stopping of the reels, and the determination if a win has occurred at the primary winning line. Simultaneously with such determination, said program segment maps the symbols occurring at the primary winning line into the left position of the first secondary winning line, the middle position of the second secondary winning line, and the right position of the third secondary winning line. In the event of a win at the primary winning line, the player is awarded a payout that is credited to the credit balance.

Then upon the second activation of the start lever 21, or button 24, the CPU 30 executes a control program segment that also controls the spinning and stopping of the reels, and the determination if a win has occurred at the primary winning line. This program segment maps the symbols occurring at the primary winning line into the remaining positions at the first, second and third winning lines. The CPU 30 then executes a program segment that determines if a win has occurred at any activated secondary winning line. In the event of a win at either the primary winning line, or any activated secondary winning line, the player is awarded a payout that is credited to the credit balance.

Upon the completion of the control program segment that checks, and processes winning combinations, the control program logic returns to the program segment that determines the number of winning lines activated by the player, and the above described process is then repeated.

As will be understood by those skilled in the art, many different programs may be utilized to implement the flow charts disclosed in FIG. 7 through FIG. 9. Obviously these programs win vary from one another in some degree. However, it is well within the skill of the computer programmer to provide particular programs for implementing each of the steps of the flow charts disclosed herein. It is also to be understood that the foregoing detailed description has been given for clearness of understanding only and is intended to be exemplary of the invention while not limiting the invention to the exact embodiment shown. Obviously certain modifications, variations and improvements will occur to those skilled in the art upon reading the foregoing. It is, therefore, to be understood that all such modifications, variations and improvements have been deleted herein for the sake of conciseness and readability, but are properly within the scope and spirit of the following claims.

What is claimed and desired to be secured by Letters of Patent is:

1. A gaming device for presenting a game to a player, wherein said game includes a plurality of spins, comprising:

a housing, a plurality of rotating reels, wherein the rotating reels are of the mechanical type, at least one primary pay line, a microprocessor with a computer-readable medium encoded with a computer program to control the operation of the gaming device, at least one secondary pay line that has a plurality of display positions, a computer program segment that assigns symbols occurring at said at least one primary pay line during said plurality of spins to display positions at said at least one secondary pay line, wherein the leftmost display position of said plurality of display positions of the secondary pay line may remain vacant during the second spin of said plurality of spins, a computer program segment that evaluates the symbol pattern at said primary pay line for winning combination, and a computer program segment that evaluates the symbol pattern at said secondary pay line for winning combination.

2. A gaming device as recited in claim 1, wherein said plurality of rotating reels are simulated reels on a video screen.

3. A gaming device as recited in claim 1, wherein said secondary pay line is located on a video screen.

4. A gaming device as recited in claim 1, wherein the assignment of symbols from said primary pay line into said display positions is based on predefined mapping configuration.

5. A gaming device for presenting a game to a player, wherein said game includes a plurality of spins, comprising:

a plurality of rotating reels, wherein the rotating reels are of the mechanical type, at least one primary pay line, means for controlling the operation of the gaming device, at least one secondary pay line that has a plurality of display positions, means for assigning at least one symbol occurring at said at least one primary pay line during each of said plurality of spins into a display position at said at least one secondary pay line, wherein the leftmost display position of the plurality of display positions of the secondary pay line may remain vacant during the second spin of said plurality of spins, means for evaluating the symbol pattern at said primary pay line for winning combination, and means for evaluating the symbol pattern at said secondary pay line for winning combination.

6. A gaming device as recited in claim 5 further comprising a housing.

7. A gaming device as recited in claim 5, wherein said plurality of rotating reels are simulated reels on a video display.

8. A gaming device as recited in claim 5, wherein said means for assigning at least one symbol from a primary pay line into said display position is based on predefined mapping configuration.

9. A gaming device as recited in claim 5, wherein said means for assigning at least one symbol from a primary pay line into said display position is based on random mapping.

10. A gaming device as recited in claim 5, wherein said plurality of spins are consecutive.

11. A gaming device as recited in claim 5, wherein said plurality of spins are not consecutive.

12. A gaming device for presenting a game to a player, wherein said game includes a plurality of spins, comprising:

a housing, a plurality of rotating reels, wherein the rotating reels are of the mechanical type, a microprocessor with a computer-readable medium encoded with a computer program to control the operation of the gaming device, a plurality of pay lines that includes at least one primary pay line, and at least one secondary pay line that has a plurality of display positions, a computer program segment that assigns at least one symbol occurring at said at least one primary pay line during each of said plurality of spins to a display position at said at least one secondary pay line, wherein the leftmost display position of the plurality of display positions of the secondary pay line may remain vacant during the second spin of said plurality of spins, and wherein the symbols assigned to the display positions at the secondary pay line remain at the display positions until the end of the game, a computer program segment that evaluates the symbol pattern at said primary pay line for winning combination, and a computer program segment that evaluates the symbol pattern at said secondary pay line for winning combination.

13. A gaming device as recited in claim 12, wherein said primary pay line is positioned directly at the rotating reels, and the at least one secondary pay line is positioned at a video screen.

14. A gaming device as recited in claim 12, and using a video display that simulates the movements of a plurality of reels.

15. A gaming device as recited in claim 12, further comprising means for a player to bet on the occurrence of a specific winning combination of symbols, at said secondary pay line, during said plurality of spins.

16. A gaming device comprising:

a housing, a plurality of rotating reels, at least one primary pay line, a microprocessor with a computer-readable medium encoded with a computer program to control the operation of the gaming device, a bonus game that includes a plurality of spins and at least one secondary pay line that has a plurality of display positions, a computer program segment that assigns symbols occurring at said at least one primary pay line during said plurality of spins of the bonus game to display positions at said at least one secondary pay line, wherein the leftmost display position of the plurality of display positions of the secondary pay line may remain vacant during the second spin of said plurality of spins, and a computer program segment that evaluates the symbol pattern at said secondary pay line for winning combination.

17. A gaming device for presenting a game to a player, wherein said game includes a plurality of spins, comprising:

a housing, a plurality of rotating reels with at least one primary pay line, a microprocessor with a computer-readable medium encoded with a computer program to control the operation of the gaming device, a video screen that includes a plurality of display positions, and at least one secondary pay line, a computer program segment that assigns symbols occurring at said at least one primary pay line, during said plurality of spins, to display positions at said video screen, wherein the leftmost display position of the plurality of display positions of the secondary pay line may remain vacant during the second spin of said plurality of spins, and wherein the symbols assigned to said display positions at the secondary pay line remain at the display positions until the end of the game, a computer program segment that evaluates the symbol pattern at said primary pay line for winning combination, and a computer program segment that evaluates the symbol pattern at said secondary pay line for winning combination.

18. A method for a gaming device that includes a plurality of reels and a microprocessor with a computer-readable medium encoded with a computer program to control the operation of the gaming device, wherein said gaming device employs at least one primary pay line, and at least one secondary pay line that has a plurality of display positions, and wherein said computer program includes an algorithm comprising the steps of:

assigning symbols occurring at said at least one primary pay line, during a game that includes a plurality of spins, to display positions at said at least one secondary pay line, wherein the leftmost display position of the plurality of display positions of the secondary pay line may remain vacant during the second spin of said plurality of spins, and wherein said symbols assigned to the display positions at the secondary pay lines remain at said display positions until the end of the game, evaluating the symbol pattern at said primary pay line for winning combination, and evaluating the symbol pattern at said secondary pay line for winning combination.

* * * * *